US006458062B2

(12) United States Patent
Conner

(10) Patent No.: US 6,458,062 B2
(45) Date of Patent: Oct. 1, 2002

(54) ABDOMINAL EXERCISE DEVICE AND METHOD

(76) Inventor: G. Wayne Conner, 1056 Quail Hill Ave., Newton, NC (US) 28658

( * ) Notice: Subject to any disclaimer, the term of this patent is extended or adjusted under 35 U.S.C. 154(b) by 0 days.

(21) Appl. No.: 09/928,050

(22) Filed: Aug. 13, 2001

Related U.S. Application Data

(62) Division of application No. 09/345,365, filed on Jul. 1, 1999, now Pat. No. 6,309,329.

(51) Int. Cl.[7] ..... A63B 21/00

(52) U.S. Cl. ..... 482/129; 482/130

(58) Field of Search ..... 482/140, 132, 482/121, 125–130, 906, 907, 122, 72; D21/692

(56) References Cited

U.S. PATENT DOCUMENTS

| | | | | | |
|---|---|---|---|---|---|
| 5,070,863 | A | * | 12/1991 | McArthur et al. | 482/130 |
| 5,141,482 | A | * | 8/1992 | Horn | 482/130 |
| 5,256,126 | A | * | 10/1993 | Grotstein | 482/142 |
| 5,518,487 | A | * | 5/1996 | Hallmark | 482/140 |
| 6,056,676 | A | * | 5/2000 | Adams | 482/142 |
| 6,312,366 | B1 | * | 11/2001 | Prusick | 482/130 |

* cited by examiner

*Primary Examiner*—Jerome W. Donnelly

(57) ABSTRACT

An exercise device and method of use are provided which allows the user to exercise and strengthen the spinal and abdominal muscles. The device includes a telescoping stanchion which is tension loaded with resilient bands which can be used in multiples to increase the tension and resistance needed. The height of the stanchion can be adjusted as well as its angularly position relative to a base having a seat thereon.

12 Claims, 6 Drawing Sheets

ABDOMINAL EXERCISE DEVICE AND METHOD

This is a divisional application of pending application Ser. No. 09/345,365 filed Jul. 01, 1999, now U.S. Pat. No. 6,309,329.

BACKGROUND OF THE INVENTION

1. Field of the Invention

The invention herein pertains to a device for exercising end building strength for the human body, and it is particularly concerned with exercise for the abdominal and spinal muscles.

2. Background and Objectives of the Invention

Many exercise machines have been developed in recent years for strengthening and exercising various muscles of the human body. For example, abdominal muscles can be strengthened using the devices as set forth in my prior U.S. Pat. Nos. 5,766,118 and 5,871,424.

However, such prior art devices do not adequately exercise the abdominal and spinal muscles simultaneously. Also, such prior art devices do not have the adjustability needed for specific muscle areas. In addition, such prior art devices are not built to withstand the wear and tear of continuous use in an exercise gym or similar commercial environment.

Thus, with the disadvantages and problems associated with prior art devices, it is an objective of the present invention to provide an exercise device which is easy to learn to use and adjust for an individual's particular needs.

It is also an objective of the present invention to provide an exercise device which includes a movable stanchion which is adjustably joined to a base.

It is yet still another objective of the present invention to provide an exercise device and method which will allow the user to exercise and strengthen the abdominal and spinal muscles simultaneously.

It is another objective of the present invention to provide an exercise device which includes resilient bands which can be affixed to the movable stanchion for resistance purposes.

Various other objectives and advantages of the present invention will become apparent to those skilled in the art as a more detailed description is set forth below.

SUMMARY OF THE INVENTION

An exercise device and method are presented whereby a user can readily strengthen the abdominal and spinal muscles. The device includes means for adjusting the device to one's particular needs and also allows for increasing the tension desired by the use of multiple resilient bands. A metal frame including a seat is affixed to a movable stanchion. The stanchion can be adjusted to the approximate shoulder height of the sitting user. The stanchion includes an arm support at the top whereby the user's forearms press the arm support downwardly, causing the stanchion to descend under tension. The greater the decent, the greater the tension and resistance. The stanchion is adjustable to various angles from the base from an angle of zero degrees (vertical) to an approximate horizontal position of about ninety degrees with the use of a removable pin.

During exercises, as the stanchion is depressed while in its vertical posture, the abdominal muscles are contracted whereas the back or spinal muscles are elongated. Likewise, when arm pressure is released from the stanchion, the abdominal muscles elongate or expand and the spinal or back muscles contract.

DETAILED DESCRIPTION OF THE PREFERRED EMBODIMENTS AND OPERATION OF THE INVENTION

Figure 1:
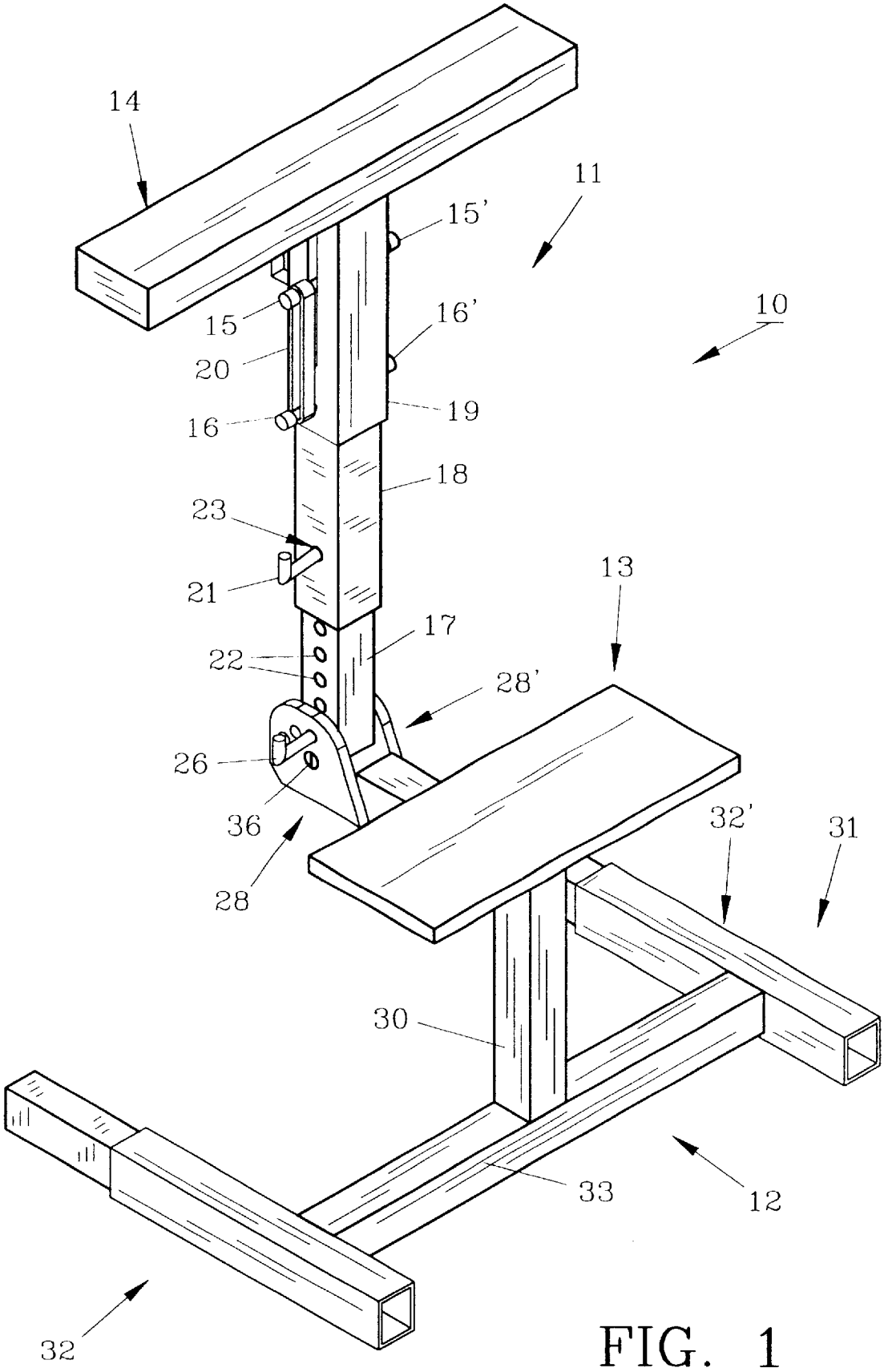
FIG. 1 demonstrates a perspective view of the exercise device of the present invention.
Figure 2:
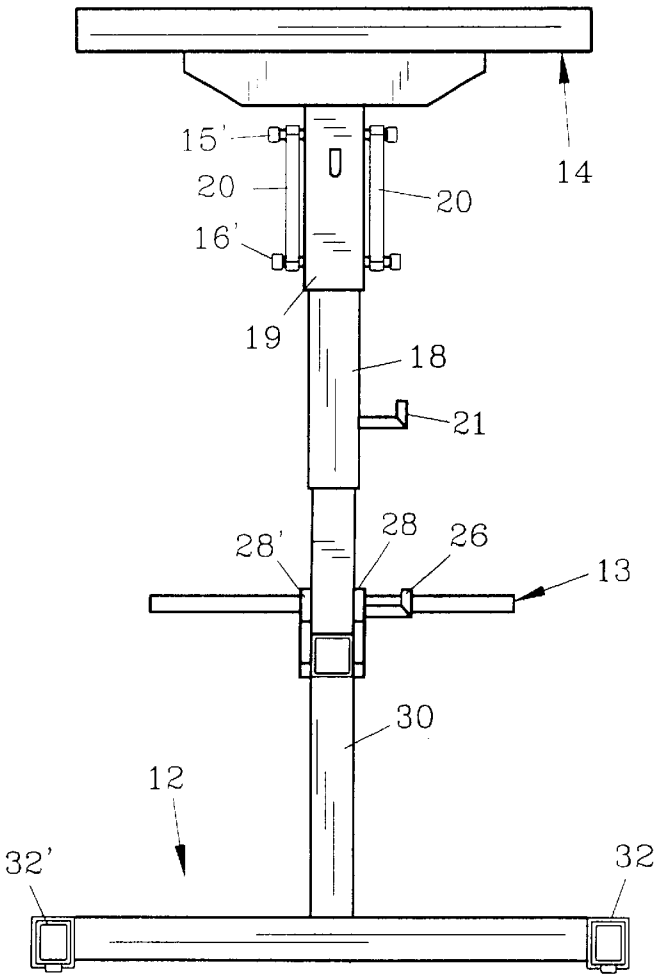
FIG. 2 shows a front elevational view of the device as shown in FIG. 1.

For a better understanding of the invention and its method, turning now to the drawings, FIG. 1 demonstrates the preferred form of exercise device 10 which includes movable stanchion 11 affixed to base 12 with seat 13 mounted thereto. Arm support 14 is a substantially horizontal member formed from metal and may optionally be covered with foam rubber or the like (not seen) for comfort purposes as desired. Stanchion 11 includes resilient band retainers 15, 15' and 16, 16'. Band retainers 15, 15' slide within slots 25, 25' (25' not shown) on opposite sides of upper stanchion section 19. As further seen, stanchion 11 includes first section 17 which may be formed of tubular steel, second section 18 also formed from tubular steel and third or upper section 19 all formed from tubular steel and sized for telescoping engagement. As would be understood band retainers 16, 16' are affixed such as by welding to upper section 19 whereas band retainers 15, 15' are affixed to second section 18. Upper section 19 telescopically slides along second section 18 during exercising. Bands 20 (FIG. 2) are formed from durable rubber or other suitable elastic polymeric materials. The height of stanchion 11 is adjustable by manually removing pin 21 and placing it in different apertures 22 which are positioned in first section 17, by aligning aperture 23 of second section 18 therewith depending on the particular height desired and comfort of the user.

Figure 3:
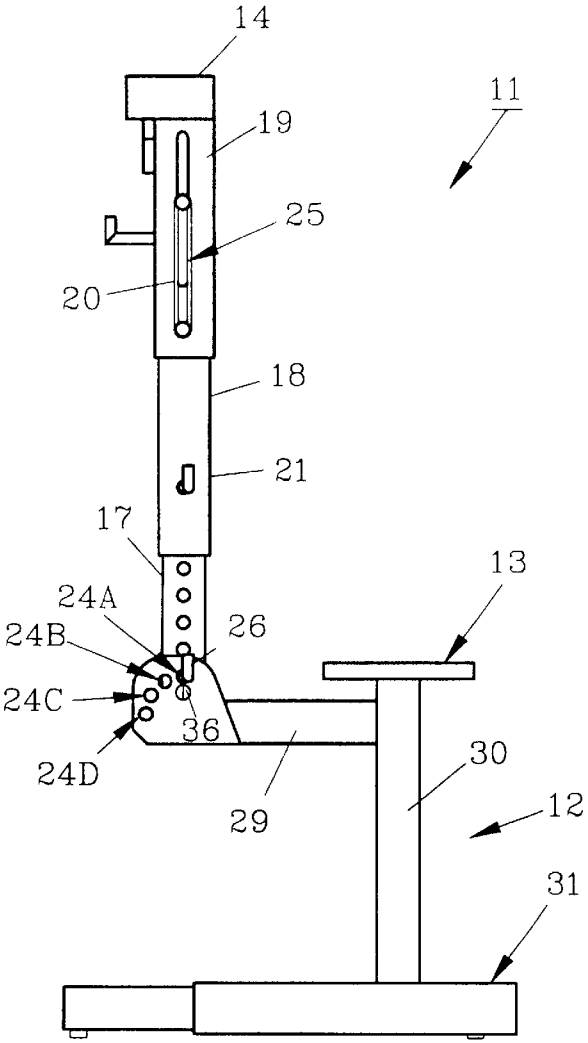
FIG. 3 pictures a right side elevational view of the device as shown in FIG. 1.

Stanchion 11 can also be adjusted to various vertical positions as determined by pin 26 placement in openings 24A, 24B, 24C or 24D. Openings 24A–D allow adjustment of stanchion 11 in approximate thirty degree increments from the vertical position (zero degrees) as shown in FIG. 3 to a horizontal position (ninety degrees not shown). Pin 26 is manually removed from openings 24A–D, 24A'–D' (not seen) within stanchion guides 28, 28'. Stanchion 11 rotates around axle 36 mounted in guides 28, 28' which are rigidly affixed such as by welding or the like to horizontal base member 29 which is attached to seat post 30 Seat post 30 is affixed to U-shaped base frame 31 which as shown in FIG. 1, includes telescoping feet 32, 32'. Feet 32, 32' can be extended or retracted as needed for stability, depending on the particular exercise and the angular position of stanchion 11. Feet 32, 32' are extended to their maximum when stanchion 11 is in a horizontal configuration. Feet 32 and 32' are joined to horizontal member 33 which in turn is affixed at the bottom of seat post 30.

Figure 4:
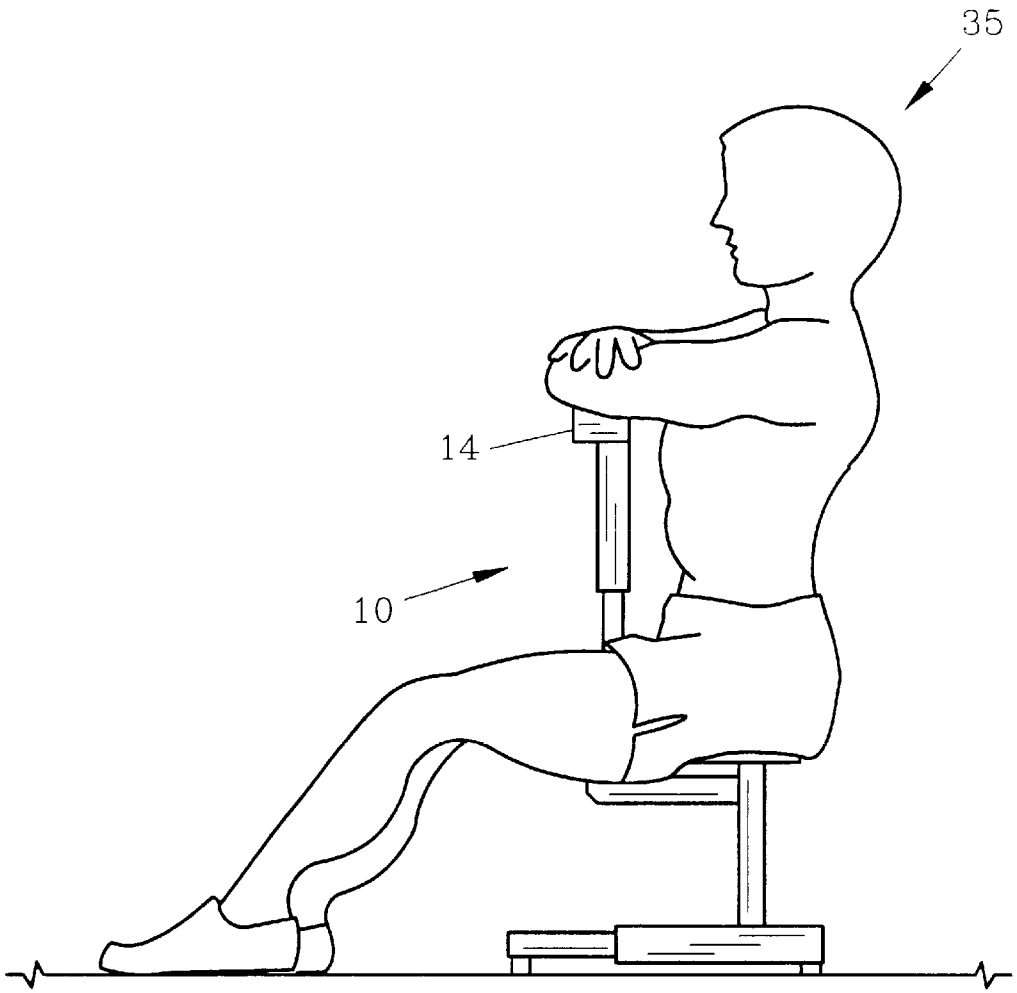
FIG. 4 features a schematic view of one configuration of the device in use prior to the user applying pressure to the stanchion.
Figure 5:
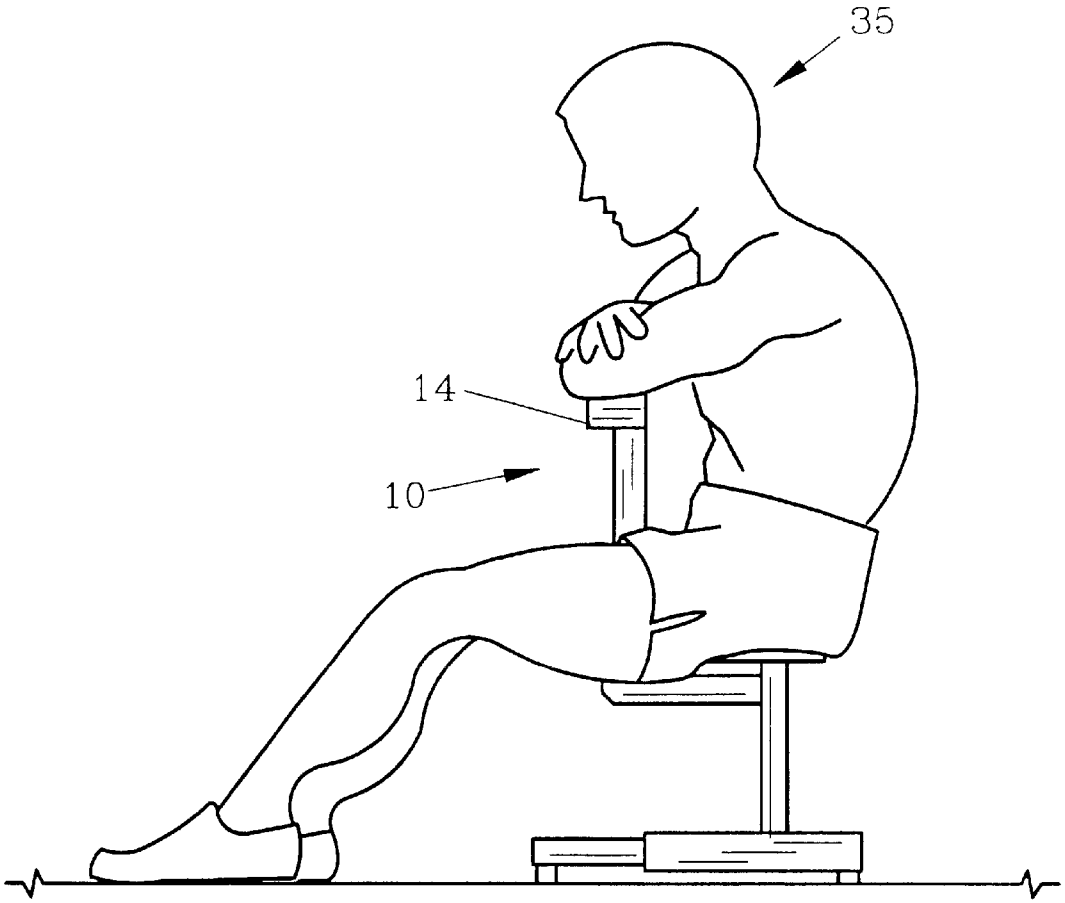
FIG. 5 depicts the device as seen in FIG. 4 with the stanchion depressed and the abdominal muscles of the user in a contracted form.

In use, stanchion 11 can be positioned in a vertical posture by use of openings 24A, 24A' as shown in FIG. 3 such as by user 35 in FIG. 4. User 35 then places his folded arms on arm support 14 and by pressing downwardly, as shown in FIG. 5 stanchion 11 is depressed while the abdominal muscles are contracted and the spinal or back muscles are extended. Thereafter, by releasing pressure on arm support 4, stanchion 11 returns to its original upright position as shown in FIG. 4 by resilient bands 20.

Figure 6:
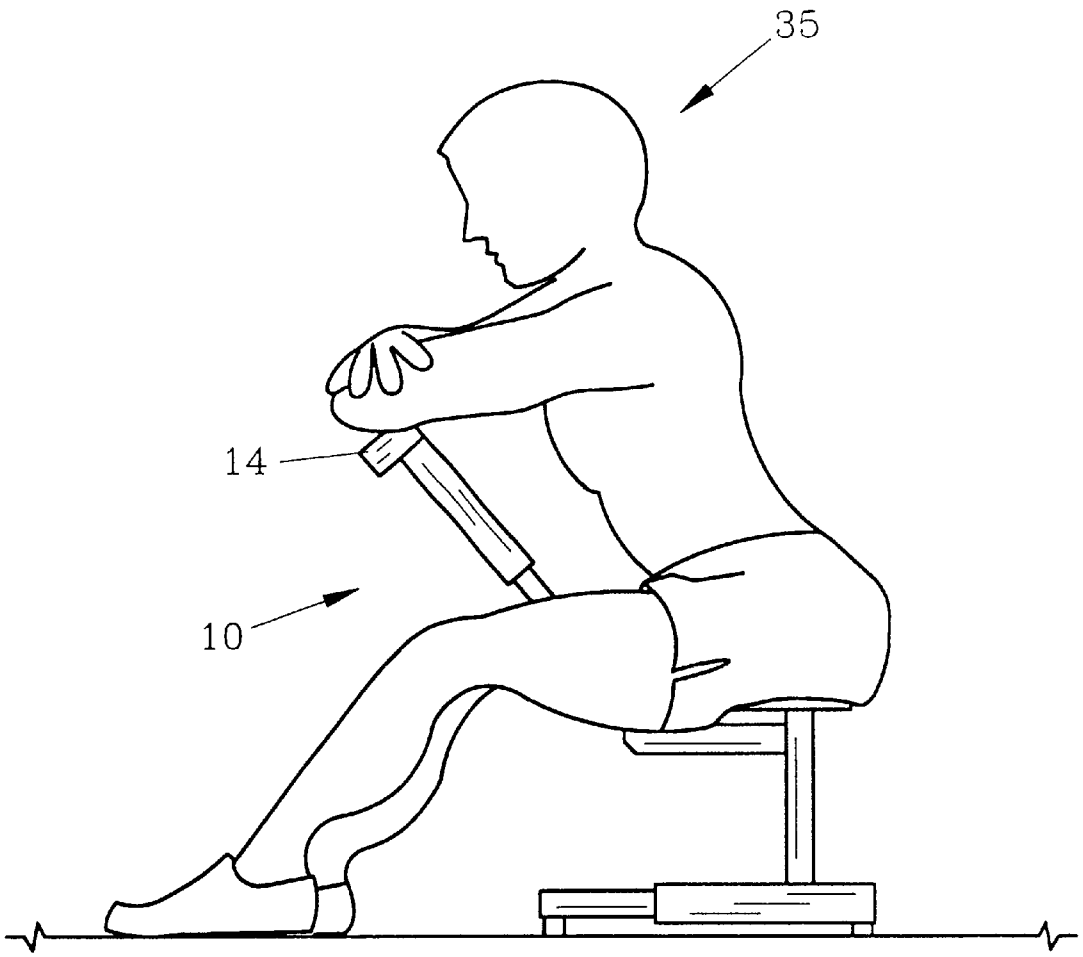
FIG. 6 illustrates another schematic configuration of the exercise device of FIG. 1 with the stanchion positioned at an approximate sixty degree angle from the vertical.
Figure 7:
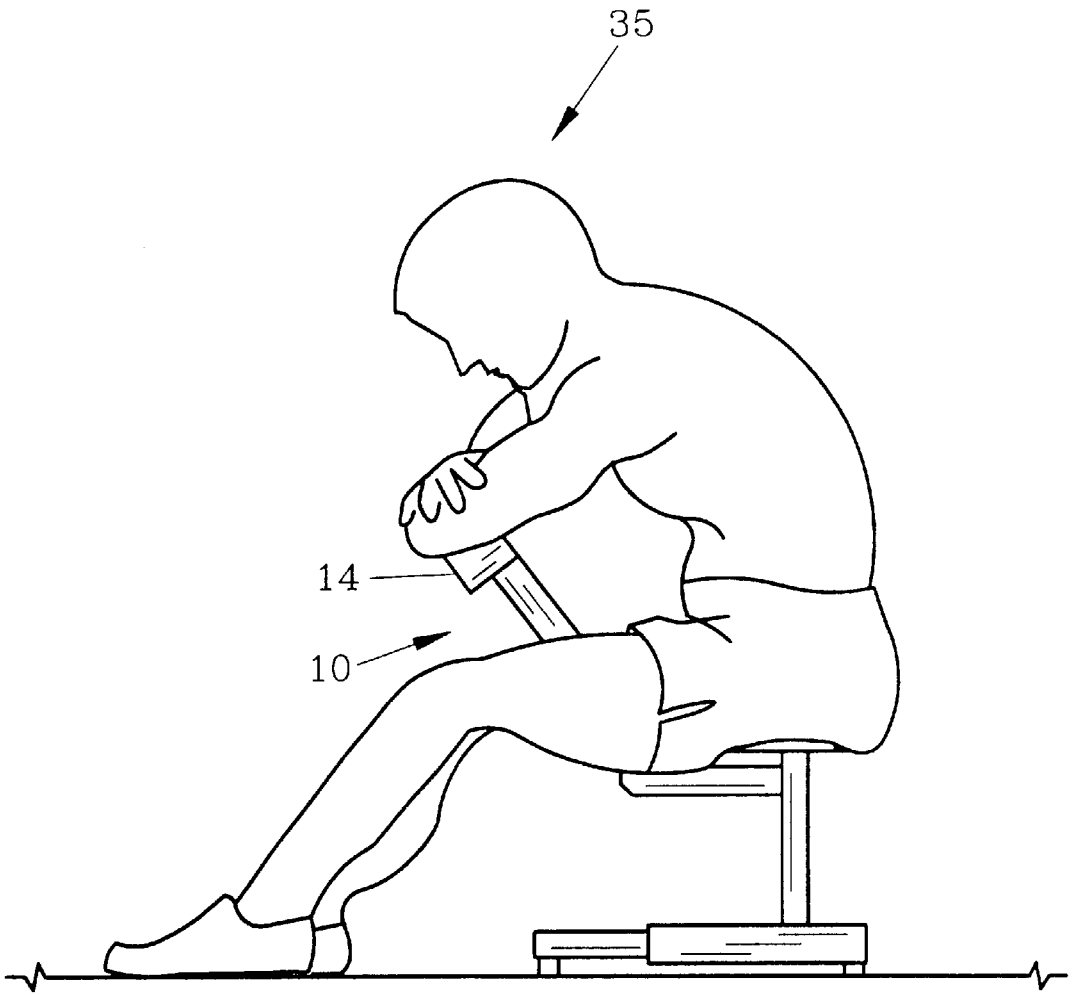
FIG. 7 shows the configuration as seen in FIG. 6 with the stanchion depressed and the back muscles elongated.

In FIG. 6 opening 24C is used in stanchion guides 28, 28' for a different configuration. By changing the angle of stanchion 11, some different muscles are employed in the depression of stanchion 11 as seen in FIG. 7. Again, once stanchion 11 is released, it returns to its extended posture as shown in FIG. 6 at an angle of approximately sixty degrees from the vertical. Full details of exercise device 10 are not seen in FIGS. 4–7 as these figures are merely schematic representations for illustrative purposes of its use.

The method of use of exercise device 10 as described above will vary depending on the particular user and the particular goals to be accomplished. More or less resilient bands can be used as needed and the configuration adjustments to exercise device 10 allow infinite variety.

The illustrations and examples provided herein are for explanatory purposes and are not intended to limit the scope of the appended claims.

I claim:

1. A method of exercising the abdominal and spinal muscles while sitting proximate a movable, resistive stanchion which can be angularly adjusted, comprising the steps of:

(a) adjusting the stanchion to a desired angle from the vertical;

(b) placing the arms in front of the body on the stanchion;

(c) locking the shoulders in place with the arms on the stanchion; and (d) depressing the stanchion with the arms with the shoulders locked in place while extending the back muscles and while contracting the abdominal muscles by bending the upper body forward.

2. The method of claim 1 wherein adjusting the stanchion to a desired angle comprises the step of rotating the stanchion away from the user.

3. The method of claim 2 wherein placing the arms of the user on the stanchion comprises the step of placing the forearms of the user on the stanchion.

4. The method of claim 1 further comprises the step of allowing the stanchion to return to its original position.

5. The method of claim 2 wherein rotating the stanchion comprises rotating the stanchion between 0° and 90° from the seat.

6. A method of exercising the abdominal and spinal muscles of the body with a resistance stanchion comprising the steps of:

(a) sitting in an upright position;

(b) locking the shoulders in place with the arms in front of the body with the arms on the stanchion;

(c) contracting the abdominal muscles and elongating the spinal muscles with the shoulders locked to move the upper body in a forward arc while forcefully depressing the stanchion with the arms; and (d) thereafter lessening the force exerted by the arms to elongate the abdominal muscles while contracting the spinal muscles as the shoulders remain locked in place to move the upper body in a rearward arc to its original posture as the resistance is lessened.

7. The method of claim 6 wherein encountering resistance comprises the step of encountering resistance to the arms as they move downwardly while locked in place as the abdominal muscles are contracted.

8. The method of claim 6 wherein locking the shoulder in place comprises the step of crossing the arms in front of the body.

9. A method of exercising the abdominal and back muscles using an exercise device which includes a seat and a resistive stanchion in front of the seat which can be adjusted to angles from 0° and 90° from the vertical comprising the steps of:

a) adjusting the angle of the stanchion to a vertical position for minimal abdominal exercise;

b) sitting on the seat with the shoulders locked in place with the arms in front of the body crossed on the stanchion;

c) contracting the abdominal muscles as the upper body bends in a forward arc while the shoulders remain locked in place and the arms depress the stanchion; and thereafter d) allowing the abdominal muscles to elongate as the arms release the stanchion and the upper body returns to its original posture.

10. The method of claim 9 further comprising the step of adjusting the stanchion to an angle from the vertical to increase the inward contraction of the abdominal muscles.

11. The method of claim 10 wherein adjusting the stanchion to an angle comprises adjusting the stanchion to an angle of 60° from the vertical to increase the inward contraction of the abdominal muscles.

12. The method of claim 9 wherein adjusting the angle of the stanchion comprises the step of adjusting the angle of the stanchion by manually removing a pin from the stanchion.

* * * * *